US008778132B2

(12) United States Patent
Turner

(10) Patent No.: US 8,778,132 B2
(45) Date of Patent: Jul. 15, 2014

(54) SUPPORT FIXTURE FOR ACID ETCHING OF PCD INSERTS

(75) Inventor: Allen Turner, Layton, UT (US)

(73) Assignee: Stingray Group, LLC, Layton, UT (US)

( * ) Notice: Subject to any disclaimer, the term of this patent is extended or adjusted under 35 U.S.C. 154(b) by 575 days.

(21) Appl. No.: 13/030,776

(22) Filed: Feb. 18, 2011

(65) Prior Publication Data

US 2012/0048468 A1 Mar. 1, 2012

Related U.S. Application Data

(60) Provisional application No. 61/306,347, filed on Feb. 19, 2010.

(51) Int. Cl.
*C23F 1/08* (2006.01)

(52) U.S. Cl.
USPC ..... 156/345.11; 156/345.51

(58) Field of Classification Search
USPC ..... 175/432, 435, 405.1; 156/345.51, 156/345.11; 76/108.4
See application file for complete search history.

(56) References Cited

U.S. PATENT DOCUMENTS

| | | | | |
|---|---|---|---|---|
| 3,986,610 | A * | 10/1976 | Hawn | 206/592 |
| 2007/0169419 | A1* | 7/2007 | Davis et al. | 51/293 |
| 2007/0284152 | A1 | 12/2007 | Eyre et al. | |
| 2010/0011673 | A1* | 1/2010 | Shamburger | 51/309 |
| 2010/0012391 | A1* | 1/2010 | Shamburger | 175/434 |
| 2011/0056141 | A1* | 3/2011 | Miess et al. | 51/295 |
| 2012/0048468 | A1* | 3/2012 | Turner et al. | 156/345.51 |

* cited by examiner

*Primary Examiner* — Sylvia R MacArthur
(74) *Attorney, Agent, or Firm* — Pate Peterson PLLC; Brett Peterson

(57) ABSTRACT

A fixture for etching PCD drill inserts is provided. The fixture design allows the fixture to be injection molded, significantly reducing costs and allowing the fixture to be disposed of after a single use. The fixture allows for faster use and more accurate etching of the PCD insert.

23 Claims, 5 Drawing Sheets

SUPPORT FIXTURE FOR ACID ETCHING OF PCD INSERTS

PRIORITY

The present application claims the benefit of U.S. Provisional Application Ser. No. 61/306,347, filed Feb. 19, 2010, which is herein incorporated by reference in its entirety.

THE FIELD OF THE INVENTION

The present invention relates to acid etching of polycrystalline diamond compacts inserts. More specifically, the present invention relates to a support fixture for the acid etching of polycrystalline diamond (PCD) inserts used in drill bits and industrial cutters.

BACKGROUND

PCD inserts are used to form the cutting tips on underground drill bits, such as those used to drill oil and gas wells. Such inserts are cylindrical in nature, having a substrate which is typically sintered carbide and a layer of sintered polycrystalline diamond on an end of the cylinder. Multiple of such inserts are attached to drill bits as the PCD forms a durable cutting edge.

One limitation in the use of PCD cutting tips is the solvent metal which occupies the interstitial spaces between the diamond crystals. The diamond accounts for about 85 to 95 percent of the PCD, and the remaining material is a metal which acts as a solvent for carbon and a catalyst for diamond formation while sintering the PCD. The fraction of solvent metal is sufficient to cause problems in using the resulting PCD cutting insert. One problem is that the solvent metal expands more with temperature than diamond, and can cause cracking of the PCD layer as the cutting insert is used. Another limitation is that the solvent metal, being a solvent for carbon during the formation of diamond crystals, also acts as a carbon solvent for the degradation of the diamond at elevated temperatures. As such, the solvent metal remaining in the PCD causes the diamond to convert into carbon dioxide, carbon monoxide, or graphite at temperatures near 700 degrees Celsius.

As such, it is desirable to remove the solvent metal from the PCD cutting inserts before use. The solvent metal may be etched from the PCD using a mixture of strong acids, such as hydrofluoric and nitric acids (HF and $HNO_3$). U.S. Patent Publication 2007/0284152 discusses the use of PCD cutting inserts, the problems associated with the solvent metal remaining in the PCD, and the etching of the PCD in acid to remove the solvent metal. In removing the solvent metal from the sintered diamond with acid, it is necessary to protect the substrate from the acid, as it is not desirable to etch or erode the substrate.

U.S. 2007/0284152 shows a fixture in FIG. 12 which is used to hold the PCD insert during etching and to protect the substrate from the acid. For discussion, the fixture is reproduced as Prior Art FIG. 2. FIG. 1 shows a typical PCD cutter insert 10. The insert 10 includes a substrate 14 and a PCD layer 18. As discussed, the substrate 14 is typically sintered carbide, which is comprised of metal carbides sintered together by metals. The PCD layer 18 typically includes about 85 to 95 percent diamond crystals and the remainder an appropriate solvent catalyst metal. The insert 10 is typically about 0.5 inches in diameter and about 0.75 inches in length. To increase the useful life of the insert 10, it is desirable to remove the solvent metal from between the diamond crystals.

FIG. 2 shows a cross-sectional view of a prior art fixture 22 used to hold the insert 10 in order to acid etch the PCD layer 18 to remove the solvent metal from between the diamond crystals. The fixture 22 has a center bore 26 which receives in insert 10, a hole 42 connecting the center bore through the back side of the fixture, and a groove 34 formed adjacent the front of the center bore. In use, the insert 10 is placed into the center bore 26 of the fixture 22. Afterwards, an elastomeric o-ring 30 is placed into the O-ring groove 34 formed in the front part of the bore 26. The insert 10 is then slid out of the bore 26 into the position shown, causing the o-ring 30 to seat on the diamond layer 18. A rubber stopper 38 is then placed into the hole 42 formed in the back of the fixture 22. The insert 10 is thus sealed into the fixture 22, having only a portion of the diamond table 18 exposed for etching. Etching is accomplished by placing the fixture 22, with the diamond table 18 facing downwardly, into a shallow bath of concentrated acid. The acid bath is kept at a desired temperature for a desired time period. Typically, the inserts 10 are etched for a period of 5 to 10 days in order to remove the solvent metal to a sufficient depth.

There are several problems associated with the fixtures 22 of FIG. 2. One significant problem is the expense of the fixture 22. The o-ring groove 34 must be machined into the fixture 22, making the cost of the fixture about $4.00 each. Since the fixtures typically may be used only a few times, the cost per insert etched is high. Another problem with the fixtures 22 is the time required to load the insert 10 into the fixture. Multiple steps are required to load the insert 10, install the o-ring, and set the insert at the proper depth. This increases the time required for assembly prior to etching, raising the cost of etching the insert 10.

Additionally, the O-ring 30 itself also presents a weakness in the design. Since the O-ring is elastomeric, it can be nicked or damaged while pushing the diamond table 18 through the o-ring during installation. Damage to the o-ring often results in a failed seal and thus an insert which is damaged during etching. Additionally, the O-ring 30 itself adds significant cost to the procedure, since the O-ring costs about $0.50, and is replaced after each use. Even using an O-ring 30 properly selected for the acids, such as a Viton® o-ring, the o-ring periodically fails while etching, resulting in a damaged part. Even if the o-ring 30 does not fail, it is typically softened by the acid and must be laboriously removed from the PCD insert 10 after etching.

A final limitation of the fixture 22 is the inability to precisely delineate the etched and non-etched portions of the diamond layer 18. FIG. 3 illustrates an etched PCD insert 10*a*. The o-ring 30 and fixture 22 produce an irregular border between the non-etched diamond layer 18 and the etched portion of the diamond layer 18*a*. The irregular boundary between the etched and non-etched portions of the diamond layer 18 require conservative placement of the insert 10 in the fixture 22 so as to prevent etching of the substrate 14. Additionally, an irregular boundary between etched and non-etched diamond layer 18 may result in damage to or failure of the insert 10 at the portions of the diamond layer 18 which still have solvent metal therein.

There is thus a need for an improved fixture for etching PCD drilling inserts. There is a need for an etching fixture which is easier to use, more reliable, and less expensive than prior art fixtures.

SUMMARY OF THE INVENTION

It is an object of the present invention to provide an improved fixture for etching PCD drilling inserts.

According to one aspect of the invention, a fixture is provided which does not require the use of an o-ring seal. The fixture thus eliminates the various modes of o-ring failure which may occur, and eliminates the expense of the O-rings. The fixture also provides a sharp delineation between etched and non-etched diamond, allowing the diamond to be etched more consistently and allowing the diamond layer to be etched to a level closer to the substrate.

According to another aspect of the invention, a fixture design is provided which may be injection molded rather than machined, significantly reducing the cost of the fixture. By reducing the cost of the fixture, the fixture may simply be discarded after use rather than cleaning the fixture for reuse.

According to another aspect of the invention, a fixture is provided which creates a positive pressure therein when loaded. The positive pressure helps keep the acid from leaking into the fixture and provides an additional measure of safety in etching the PCD inserts.

These and other aspects of the present invention are realized in a fixture for acid etching PCD drilling inserts as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
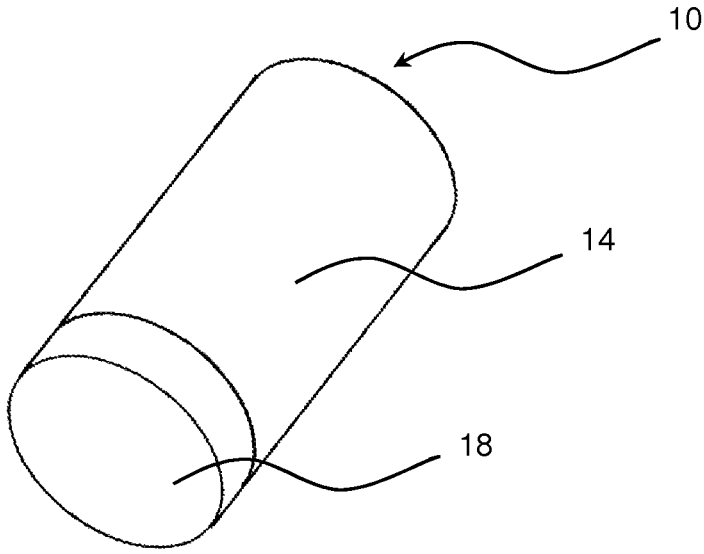
FIG. 1 (Prior Art)
FIG. 1 shows a perspective view of a known PCD drilling insert.
Figure 2:
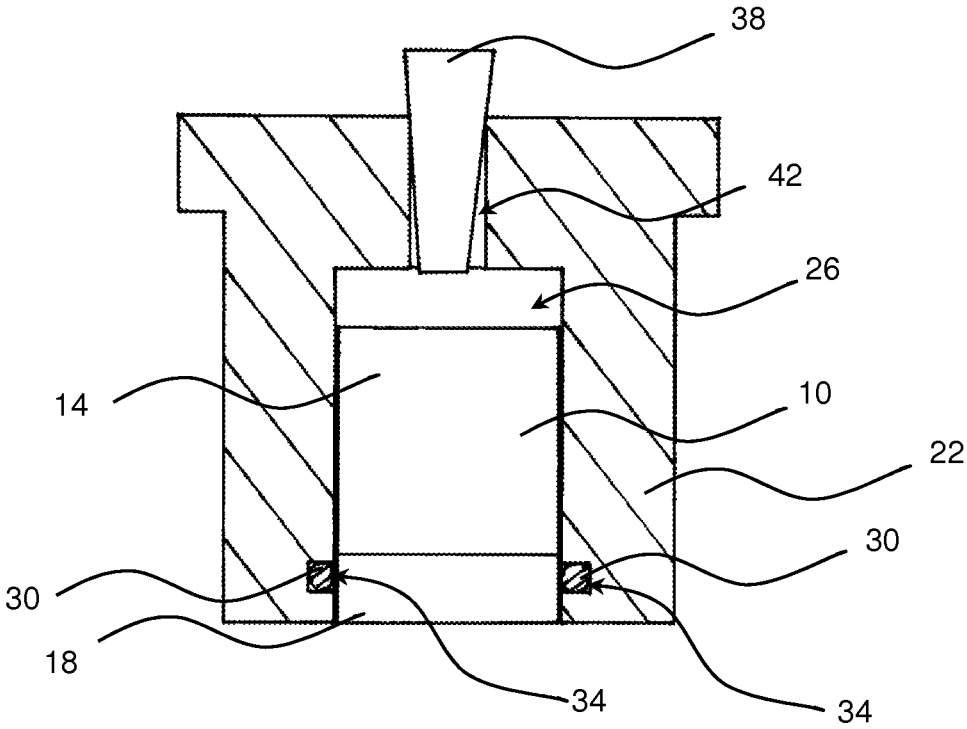
FIG. 2 (Prior Art)
FIG. 2 shows a partial cross-sectional view of a prior art etching fixture.
Figure 3:
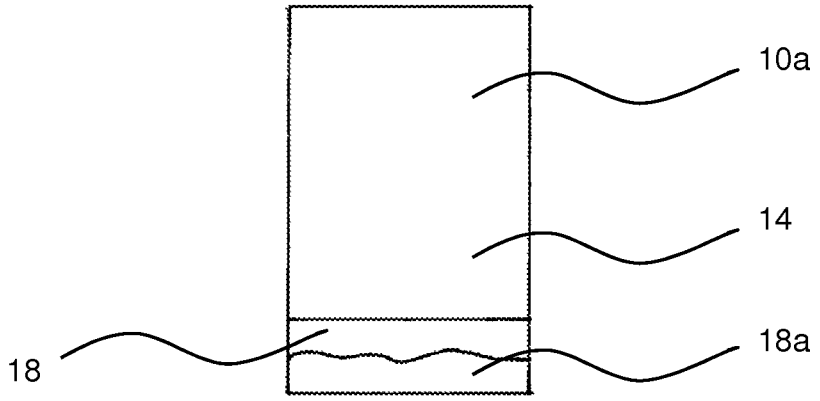
FIG. 3 (Prior Art)
FIG. 3 shows a side view of a PCD insert etched with the prior art fixture of FIG. 2.
Figure 4:
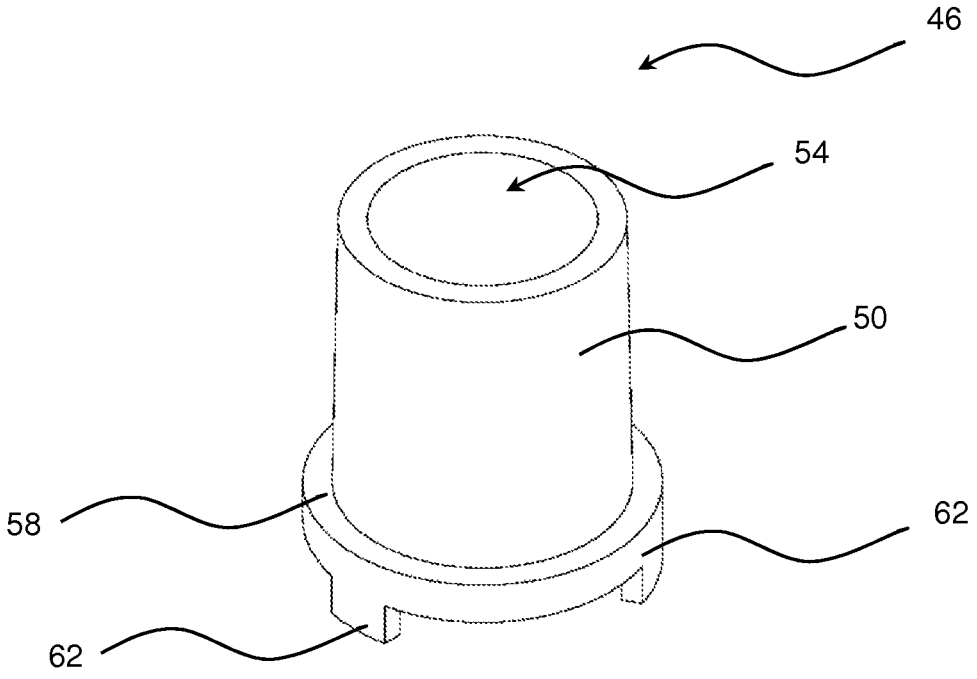
FIG. 4 shows a perspective view of an etching fixture of the present invention.

Turning now to FIG. 4, a perspective view of a fixture 46 of the present invention is shown. The fixture has a body 50 which is generally cylindrical, and has a bore 54 therethrough and a base 58 formed at the bottom thereof. The base 58 extends radially outwardly from the bottom of the body 50. The bore 54 is sized to receive a PCD insert 10. As there are different diameters of PCD inserts, different diameters of fixtures 46 are made. A plurality of feet 62 extend downwardly from the base 58. The feet 62 elevate the base 58 and the face of the insert 10 which is being etched to raise these off of the bottom of the etching tank and allow for better circulation of the acid around the PCD insert. This improves the etching of the insert.

Currently, the PCD inserts 10 are commonly 13, 16 or 19 millimeters in diameter. This application primarily discusses the 13 mm diameter insert as an example. The larger sizes of inserts 10 would use a correspondingly larger fixture 46, with similar clearance or interference in the fit. The 13 millimeter insert may be casually referred to herein as a one half inch insert, since 13 mm is 0.512 inches in diameter.

Figure 5:
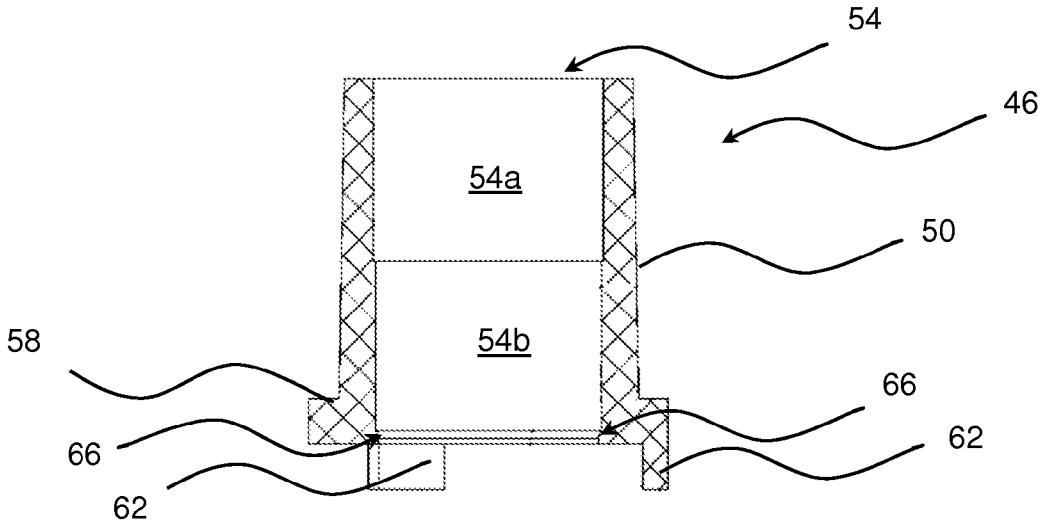
FIG. 5 shows cross-sectional view of the fixture of FIG. 4.

FIG. 5 shows a cross-sectional view of the fixture body 50. As shown, the bore 54 may be made with two sections of different diameter. As shown, the top portion 54*a* of the bore (approximately the top half) has a diameter of 0.533 inches. The lower portion 54*b* of the bore (approximately the lower half) has a diameter of 0.525 inches. These diameters allow an insert 10 having a diameter of 0.512 inches to easily be placed within the fixture body 50 while keeping the insert aligned within the body. A small rib 66 is formed at the bottom of the bore 54. The rib 66 seals against an insert 10 which is pressed through the top of the bore 54, through the lower end of the bore 54 and past the rib 66 by a desired amount.

Figure 6A:
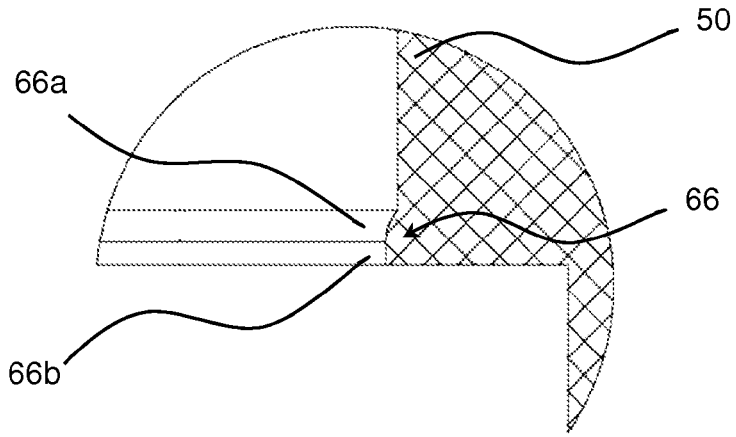
FIG. 6A shows a detailed view of the indicated section of the fixture of FIG. 5.
Figure 6B:
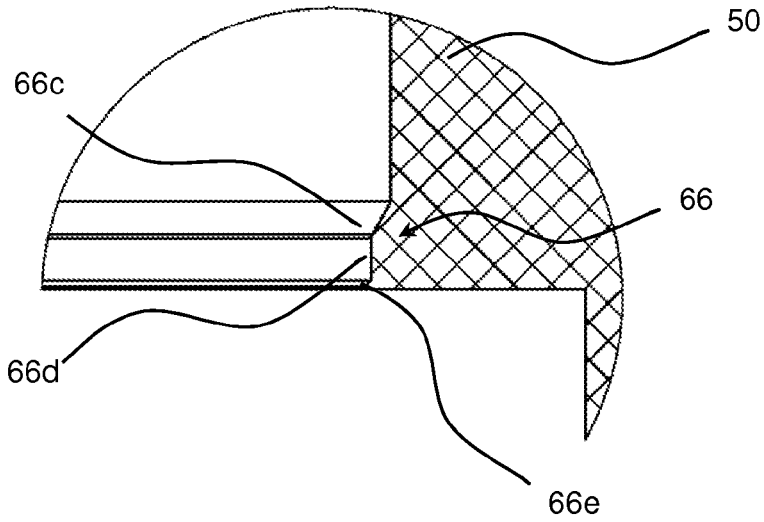
FIG. 6B shows another detailed view of the indicated section of the fixture of FIG. 5.

FIG. 6A and FIG. 6B show detailed views of the rib 66. The rib 66 extends approximately 0.03 inches into the bore 54, making the diameter of the bore 54 at the rib 66 approximately 0.47 inches. The rib thus forms an interference fit with a 0.512 inch diameter PCD drill insert. It is currently preferred to have a rib 66 which is between about 0.01 inches and 0.04 inches smaller in diameter than the insert. When an insert 10 is pressed into the body 50, the rib 66 seals against the insert. As shown in FIG. 6A, the rib 66 may have a radiused upper portion 66*a* which transitions into a lower sealing portion 66*b*. The upper portion and lower portion may both be between about 0.01 and 0.03 inches in height, and have a protrusion into the bore 54 as discussed.

As shown in FIG. 6B, the rib 66 may have an upper portion 66*c* which transitions from the bore 54 to a lower sealing portion 66*d*. The sealing portion 66*d* protrudes into the bore 54 as discussed above to create an interference fit between about 0.01 and 0.03 inches with the insert. The upper transition portion 66*c* and the lower sealing portion 66*d* are both between about 0.01 and 0.03 inches in height. The rib 66 may also have a smaller secondary rib 66*e* extending outwardly from the lower portion 66*d* and further into the bore 54. The secondary rib 66*e* is typically between about 0.001 and 0.01 inches in both height and width (protrusion into the bore 54), and preferably may be about 0.003 inches in height and protrusion into the bore.

The upper transition region 66*a*, 66*c* helps the insert move smoothly past the rib 66 without causing damage. The lower sealing region 66*b*, 66*d* presses against the insert to seal thereto. The secondary rib 66*e*, if used, provides a more easily deformable section of material to the sealing rib 66 and can improve the effectiveness and reliability of the sealing rib 66.

Different etching conditions such as time or temperature may affect the inner size of the rib 66, requiring the rib to be larger or smaller in size. Thus, the interior diameter defined by the rib 66 may be a few hundredths of an inch larger or smaller. Typically, the same amount of interference is used between the rib 66 and a larger insert 10, such as a 16 or 19 millimeter insert. That is to say that the difference in size between the inner diameter of the rib 66 and the outer diameter of the insert 10 would be approximately the same. Advantageously, the fixture 46 may be adapted to receive 16 or 19 millimeter diameter inserts by changing the diameter of the body 50 while leaving the diameter of the base 58 and location of the feet 62 the same. This allows the use of the same loading and processing equipment for different insert sizes.

Figure 7:
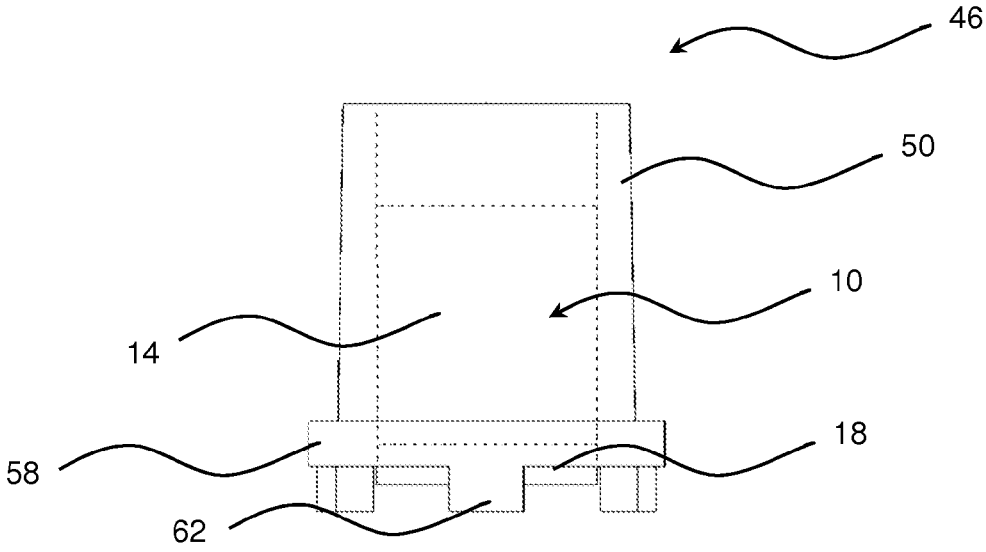
FIG. 7 shows a side view of the fixture of FIG. 4.

FIG. 7 shows a side view of the fixture body 50 with an insert 10 loaded therein. The insert 10 is placed into the top of the bore 54 and pressed downwardly past the rib 66. A simple pressing jig can be made which contacts the bottom of the base 58 and which allows the insert 10 to move downwardly past the base 58 a predetermined distance before stopping the insert. This allows the insert 10 to be easily and repeatably loaded into the fixture body 50. The prior art fixture 22 requires more time to load, requiring the insert 10 to be placed into the fixture, then the o-ring 30 to be placed into the groove 34, and finally requiring the insert to be pressed past the O-ring into position. Thus, the fixture 46 achieves a significant time savings in loading the insert 10 as well as providing a much more accurate and repeatable loading and etching process. The improved accuracy and repeatability of loading and etching allows the diamond layer 18 to be etched closer to the substrate 14.

Figure 8:
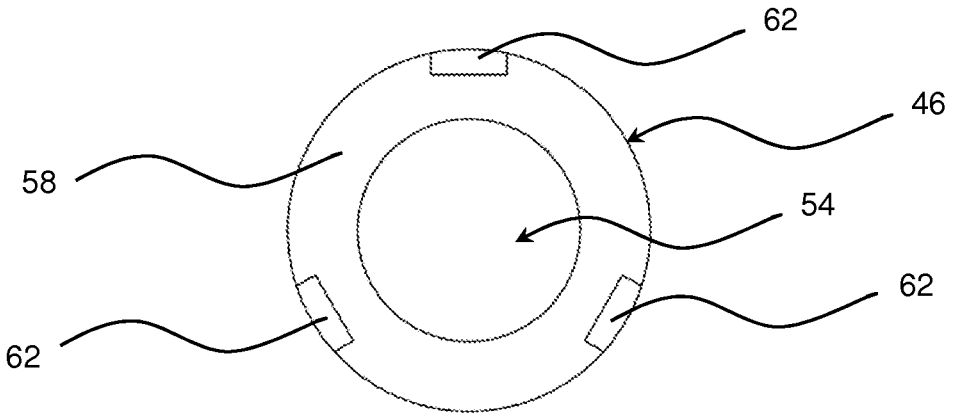
FIG. 8 shows a bottom view of the fixture of FIG. 4.

FIG. 8 shows a bottom view of the fixture body 50, showing the placement of the feet 62. FIGS. 7 and 8 illustrate how the fixture body 50 keeps the diamond layer 18 off of the bottom of the etching reservoir, and allows better circulation of acid around the etched face of the diamond layer 18. This allows for more consistent etching of the diamond layer 18.

Figure 9:
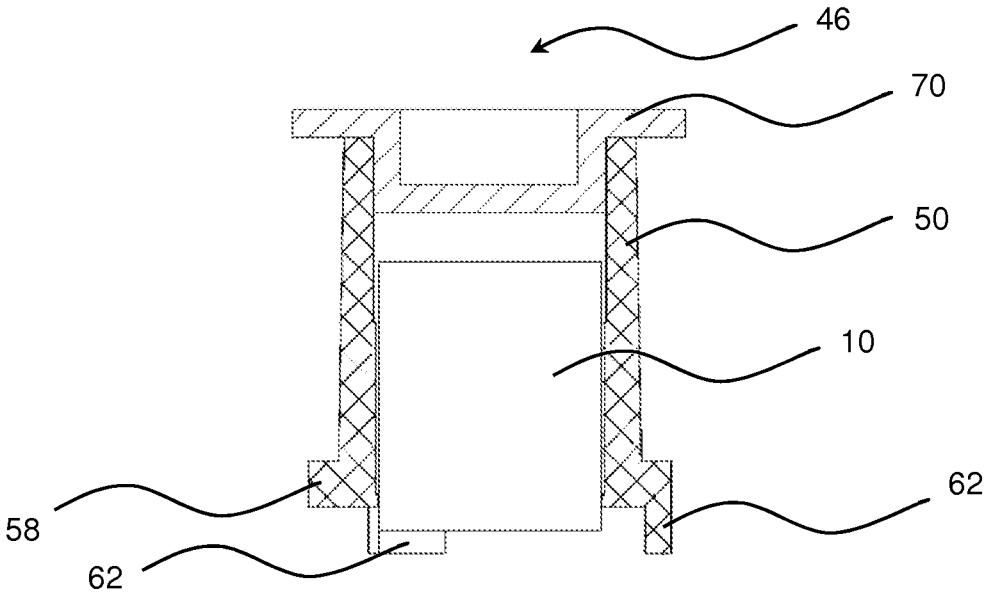
FIG. 9 shows a cross-sectional view of the fixture of FIG. 4.

FIG. 9 shows a cross-sectional view of the fixture 46 ready for etching. The fixture 46 has a PCD insert 10 loaded into the body 50. After pressing the insert 10 into place, a cap 70 is pressed into the top of the bore 54. The cap 70 extends downwardly into the bore approximately 0.2 inches. The cap 70 has a slight interference fit with the bore 54, sealing against the bore 54 as it is pushed into place. As such, inserting the cap compresses the air in the bore 54 and causes a positive pressure to be formed inside of the bore 54. This positive pressure helps to keep the etching acid out of the bore 54 while etching the insert 10, further reducing the risk of leakage.

The cap 70 extends outwardly beyond the body 50 and forms a lifting flange which makes it easier to move the fixtures 46 into and out of the acid reservoir. The fixture body 50 and cap 70 are preferably made from a plastic such as polypropylene, polyethylene, polyvinylidene fluoride, polytetraflouroethylene, and mixtures thereof. Other plastics that may also work could be Liquid Crystal Polymer (LCP) or PolyEtherKetone (PEK). A currently preferred material is C3350 TR polypropylene co-polymer.

One significant advantage of the fixture 46 is that the boundary between etched and non-etched portions of the diamond layer 18 can be precisely controlled. The rib 66 forms a sharp delineation between etched and non-etched diamond compact. The precise control of the etching boundary allows the insert 10 to be mounted into the fixture 46 with a greater amount of the diamond layer 18 exposed, improving the temperature stability and useful life of the etched insert.

Another significant advantage of the fixture 46 is the reduction of leaks during etching. The prior art fixtures 22 had a failure rate of between 2 and 5 percent. The present fixture 46 has a failure rate of less than one percent. The reduction of the failure rate is significant because of the cost associated with producing the inserts 10 and the time and cost of etching the inserts.

Another significant advantage of the fixture 46 is the ease with which it is used. The fixture 46 may be loaded in much less time than the prior art fixture 22. The fixture 46 may also be quickly unloaded and disposed of where the relatively expensive prior art fixture needed to be cleaned for reuse. Cleaning of the prior art fixture 22 and the produced insert 10 took significant time because the o-ring was damaged by the acid and became sticky and difficult to remove from the insert 10 and fixture 22.

Another advantage of the fixture 46 is that the design of the cap 70 and body 50 allow the fixture to be more easily moved into and out of the acid reservoir for etching, and also allow a closer spacing between adjacent fixtures in the etching reservoir. This allows more inserts 10 to be etched in a batch. This is advantageous as the batch time is quite long (typically between 5 and 10 days) and the etching acid is not reused.

There is thus disclosed an improved etching fixture for PCD drill inserts. It will be appreciated that numerous changes may be made to the present invention without departing from the scope of the claims.

What is claimed is:

1. An etching system for etching cylindrical PCD inserts comprising:

a PCD insert having a generally cylindrical substrate and a layer of sintered polycrystalline diamond attached to an end of the substrate;

an etching tank having acid disposed therein;

an etching fixture body, the body having;

a bore therethrough with a diameter larger than the cylindrical PCD insert to provide a slip fit with the cylindrical PCD insert;

a rib formed at the bottom of the bore and extending inwardly into the bore to form an opening with a diameter smaller than the PCD insert to cause an interference fit with the PCD insert;

a base extending outwardly from the bottom of the body;

feet extending downwardly from the base so as to elevate the base; and wherein the PCD insert is inserted into the body such that the substrate is disposed in the bore and a portion of the layer of sintered diamond passes through the opening formed by the rib and is exposed outside of the body;

a cap inserted into the top of the bore to thereby seal the top of the bore;

and wherein the fixture is placed in acid in the etching tank such that the feet hold the portion of the layer of sintered diamond apart from the etching tank and such that the acid contacts the portion of the layer of sintered diamond to etch the portion of the layer of sintered diamond.

2. The system of claim 1, wherein the cap and body are formed from polyethylene, polypropylene, a fluoropolymer, or mixtures thereof.

3. The system of claim 1, wherein the cap and body are formed from a polymer.

4. The system of claim 1, wherein the rib extends between about 0.01 and about 0.04 inches into the bore.

5. The system of claim 4, wherein the inner diameter of the rib is between about 0.01 and 0.04 inches smaller in diameter than a PCD insert disposed in the bore.

6. The system of claim 1, wherein the rib has an upper transition portion and a lower sealing portion, the lower sealing portion being smaller in diameter than the PCD insert to cause an interference fit therewith and the upper transition portion being sloped to provide a gradual transition in diameter from the bore to the lower sealing portion.

7. The system of claim 6, further comprising a secondary sealing rib disposed on the sealing portion of the rib, wherein the secondary sealing rib defines an opening which is smaller in diameter than the sealing portion of the rib.

8. The system of claim 7, wherein the secondary sealing rib is between about 0.005 and 0.015 inches smaller in diameter than the sealing portion of the rib.

9. The system of claim 8, wherein the secondary sealing rib is between about 0.005 and 0.015 inches wide.

10. The system of claim 1, wherein the cap forms an interference fit while sliding into the bore so as to raise the air pressure inside of the bore when an insert is loaded into the bore and the cap is then inserted into the bore.

11. A system for etching a cylindrical PCD insert comprising:

a cylindrical PCD insert;

an etching tank having acid therein;

an etching fixture body, the body having;

a bore extending through the body and forming an upper opening at the top of the body and a lower opening at the bottom of the body;

a sealing rib disposed in the bore adjacent the lower opening, the sealing rib extending into the bore to define an opening which is smaller in diameter than the cylindrical PCD insert such that the sealing rib creates an interference fit with the cylindrical PCD insert when the cylindrical PCD insert is positioned through the opening; and a cap for closing the upper opening;

wherein the cylindrical PCD insert is inserted into the body such that an end thereof passes through the opening and extends out of the body;

wherein the etching fixture is placed in the etching tank in the acid; and wherein the etching fixture is supported in the etching tank to space the end of the cylindrical PCD insert apart from the etching tank such that the acid contacts the end of the cylindrical PCD insert to etch the end of the cylindrical PCD insert.

12. The system of claim 11, further comprising feet extending downwardly from a lower surface of the body, and wherein the feet space the end of the cylindrical PCD insert apart from the etching tank.

13. The system of claim 11, wherein the sealing rib is between about 0.01 and 0.04 inches wide and has an inside diameter between about 0.01 and 0.04 inches smaller than the diameter of the PCD insert.

14. The system of claim 11, wherein the sealing rib comprises a lower sealing portion and an upper transition portion which is sloped to provide a transition in diameter between the lower sealing portion and the bore.

15. The system of claim 11, further comprising a secondary sealing rib disposed on the sealing rib.

16. The system of claim 15, wherein the secondary sealing rib is about one fifth the size of the sealing rib.

17. The system of claim 11, wherein the PCD insert has a substrate and a layer of diamond disposed on an end of the substrate, and wherein the PCD insert is disposed in the bore such that the sealing rib contacts the layer of diamond and the layer of diamond extends downwardly from the bore.

18. The system of claim 17, wherein the cap seals against the bore and wherein the cap is inserted into the bore after a PCD insert is loaded into the fixture body and wherein insertion of the cap causes a positive pressure in the fixture bore.

19. The system of claim 11, wherein the body, bore, and sealing rib are a unitary structure formed from a polymer material.

20. A system for etching a cylindrical PCD insert comprising:

a sintered cutting insert;

an etching tank having acid therein;

an etching fixture body, the body having;

a hole in the body which receives the sintered cutting insert, the hole forming a first opening in the body;

a sealing rib disposed in the hole adjacent the first opening, the sealing rib extending into the hole to define an opening which is smaller than the sintered cutting insert such that the sealing rib creates an interference fit with the sintered cutting insert when the sintered cutting insert is positioned through the opening; and wherein the sintered cutting insert is inserted into the body such that an end thereof passes through the opening and extends out of the body and such that the sealing rib engages the sintered cutting insert to seal against the sintered cutting insert;

wherein the etching fixture is placed in the etching tank in the acid; and wherein the etching fixture is supported in the etching tank to space the end of the sintered cutting insert apart from the etching tank such that the acid contacts the end of the sintered cutting insert to etch the end of the sintered cutting insert.

21. The system of claim 20, wherein the hole forms a second opening in the body and wherein the system further comprises a cap for closing the second opening.

22. The system of claim 20, wherein the body, hole, and sealing rib are a unitary structure formed from a polymer material.

23. The system of claim 20, wherein the sintered cutting insert has a substrate and a layer of diamond attached to an end of the substrate, and wherein the sintered cutting insert is disposed in the hole such that the sealing rib contacts the layer of diamond and the layer of diamond extends out of the opening.

* * * * *